US005938146A

United States Patent [19]

Tang

[11] Patent Number: 5,938,146

[45] **Date of Patent: *Aug. 17, 1999**

[54] TAPE TRANSFER NOISE REDUCTION SYSTEM

[76] Inventor: Jow-Lin Tang, 524 Green Acre Dr., Fullerton, Calif. 92635

[ * ] Notice: This patent issued on a continued prosecution application filed under 37 CFR 1.53(d), and is subject to the twenty year patent term provisions of 35 U.S.C. 154(a)(2).

[21] Appl. No.: 08/813,974

[22] Filed: Nov. 26, 1996

[51] Int. Cl.[6] ..... B65H 23/00; B65H 57/14

[52] U.S. Cl. ..... 242/566; 242/615.2

[58] Field of Search ..... 242/566, 346.2, 242/615.2, 397.5, 548

[56] References Cited

U.S. PATENT DOCUMENTS 4,580,738 4/1986 Scheer ..... 242/566 X 4,883,232 11/1989 Marchetti ..... 242/566 X

*Primary Examiner*—John Q. Nguyen

*Attorney, Agent, or Firm*—Curtis L. Harrington

[57] ABSTRACT

A silencing system includes a separation roller which is urged against or located as closely as possible to the main tape roll during the removal of tape. A point of tangency between the separation roll and the main roll forms a stable separation line as the tape is separated from the main supply roll. In a first embodiment, a separation roller is mounted to be pneumatically urged against the supply roll. The separation roller directs the tape from the supply roll through what is preferably a 180° removal path to prevent any tension in the taped removed from being translated into a force which would work against the bearing force of the separation roller on the supply roll. In a second embodiment a mechanical spring is used to urge the separation roller against the supply roll. In both the first and second embodiments, one of the pivot arms is made thinner to accommodate the space normally occupied by a brake located adjacent the roll of material being separated.

13 Claims, 5 Drawing Sheets

TAPE TRANSFER NOISE REDUCTION SYSTEM

FIELD OF THE INVENTION

The present invention relates to the field of mechanical systems for transferring adhesive tape and films from one roll to another. More specifically, the present invention relates to a silencing system to enable tape transfers and tape removals to occur with a significant reduction in noise.

BACKGROUND OF THE INVENTION

The adhesive tape and film industry usually provides for the manufacture of such tapes and films in relatively large lots to take advantage of economies of scale. Tape products are elongate strips of a synthetic material to which an adhesive is applied. In some instances adhesive may be applied to both sides of tape, and the tape may be clear or colored. Films and the like are usually overlay type materials which are intended to transmit light therethrough. In the case of clear tape and clear films, the adhesive layer will also usually be clear, and highly adhesive. Hereinafter, only the term tape will be used, although all types of tapes and films are indicated by the use of the term "tape."

Usually the tape or film is manufactured and stored on a type of relatively large roll. In order to make the tape product more readily useable by the ultimate consumer, the tape may go through several processes to cut it into various widths and to roll it onto a smaller spool. Often the smaller spool is a cardboard core onto which the freshly cut tape is wound. In many cases, a large roll of tape material may go through several processing steps in which the tape is sequentially reduced to smaller and smaller sizes. It is difficult for a smaller manufacturing operation to directly convert from the largest size roll to the smallest size roll directly.

The processing of tape involves unrolling it from a storage roll, putting it through a cutting operation, and rolling it onto a smaller roll. It is the unrolling step which normally creates excessive noise. As the tape is pulled from the roll, the separation line is not constant and even and has a tendency to "jump." Even where the jump is short and the tape appears to leave the roll evenly, significant amounts of noise are generated. This noise can be heard with any roll of tape as the peeling noise when tape is removed from a roll. The amount of noise is proportional to the strength of the adhesive.

The noise generated from the separation line is transmitted to the tape portion which was just removed from the tape roll. Since the just removed portion is placed under tension to pull it away from the roll, it acts as a vibrating membrane or speaker. The principle is much like an early gramophone where the sounds were mechanically amplified from the needle with a relatively larger sized membrane.

Where larger tape rolls are processed, the membrane size available for noise generation is increased. The increased membrane size physically produces a greater volume of noise. In addition, most tape processing operations include a high speed transfer of tape. The high speed character of the operation increases both the noise, the frequency of the noise and the breadth of noise frequencies output by the operations.

In addition to tape production and cutting, other devices utilize tape rolls. Where tags and labels are applied to packaging, an over lamination tape is typically dispensed automatically from a roll. In other cases, the labels have adhesive backing and are similarly removed from a roll. In some instances the tape, label, and laminate noise is the most severe noise problem encountered by the production facility.

Where noise levels are such that employees properly need to use hearing protection, the employee productivity and awareness levels suffer. A noisy work environment and hearing protection effectively removes one of the employees' senses and increases the likelihood of an injury.

Further, where tape is used in a production environment, the tendency of the tape to make significant sized jumps or jerks from the tape roll can disrupt the processing machinery downstream. If the tape is removed from the roll unevenly, it can cause jerking action at the downstream processing portion. The jerking action can cause mis-alignment of the packaging operation, bunching of the over lamination layer, and in some instances cause physical damage to the machine. The ability of the tape to jerk can also occur at a harmonic frequency. Where harmonics are present, the ability to severely damage the machine and process is present.

Another problem is equipment compatibility. Where the supply roll mechanism has a brake or other material control structure, space needed for a silencing structure can prevent or severely limit the use of a silencing structure. Other limitations arise from any other structures which may be present at and around the supply roll.

What is therefore needed is a system and method which will enable significantly quiet operation in the removal of tape from a roll, regardless of the machine or operation in use for removing tape from a roll. The needed system and method should eliminate the possibility of harmonics in the machinery associated with the removal of the tape. The needed system and method should not significantly increase the tensioning of the machinery accepting the tape for processing.

The needed system and method should not significantly increase the labor and time necessary to operate the tape processing machinery and should be user friendly. The needed system and method for silencing tape noise should synergize with the tape processing machine to improve the overall operation and performance of the processing machine.

SUMMARY OF THE INVENTION

The silencing system of the present invention includes a separation roller which is urged against or located as closely as possible to the main tape roll during the removal of tape. The tape is separated from the main supply roll between the separation roller and the main roll. The point of tangency between the separation roll and the main roll forms a stable separation line which is physically prevented from "jumping." In a first embodiment, a separation roller is pneumatically urged against the supply roll, and in a second embodiment, a separation roller is spring urged against the supply roll. The separation roller directs the tape from the supply roll through what is preferably a 180° removal path. The 180° removal path prevents any tension in the taped removed from being translated into a force which would work against the bearing force of the separation roller on the supply roll. The separation roll creates and maintains a stable, constant, separation boundary with respect to the tape leaving the supply roll. The spacing requirements about the supply roll have been met with a pivoting sleeve which has a thicker arm at the outside and away from any interfering structures, and a thinner arm at the inside to avoid other materials, and yet not sacrifice strength.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
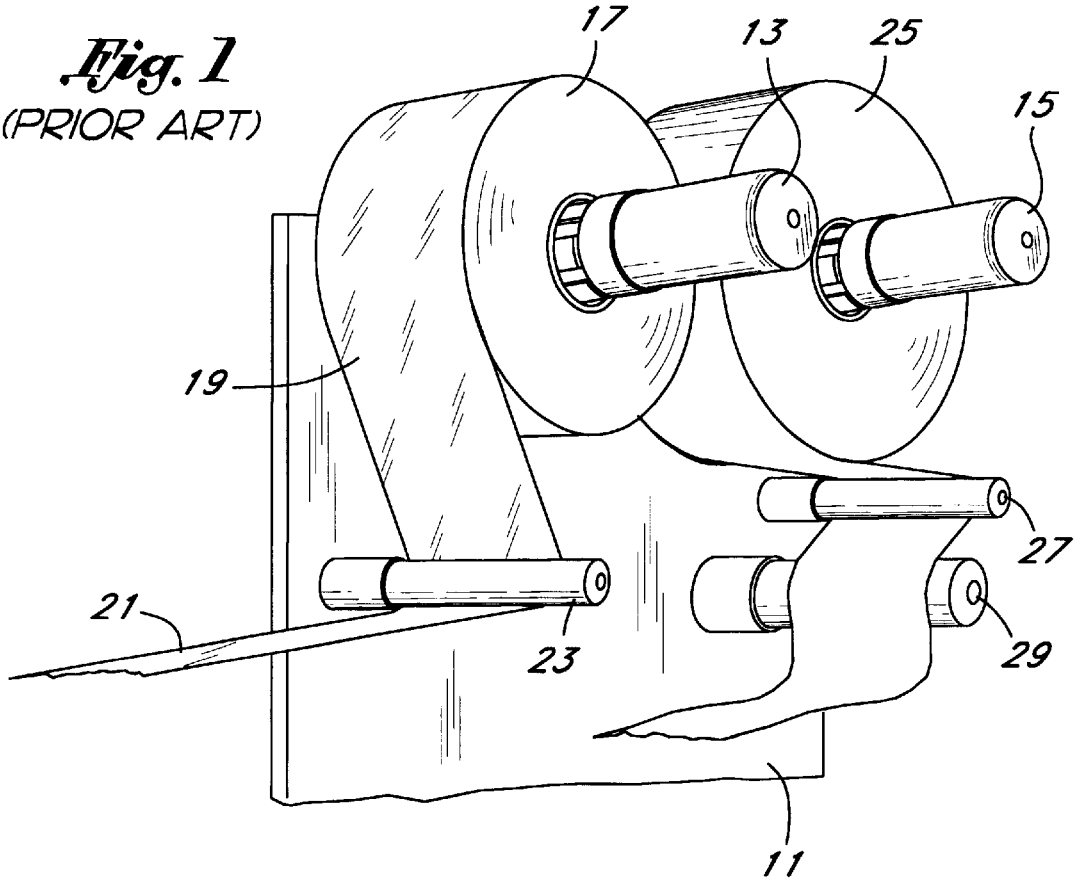
Fig. 1 (PRIOR ART)
FIG. 1 is a front view of a prior art tape removal device which suffers from an uncontrolled separation which creates noise.

The description and operation of the invention will be best described with reference to FIG. 1. FIG. 1 is a perspective view of a typical support 11 which may simply be a sheet of steel plate. The support 11 supports a pair of main supply spool axles or roller supports 13 and 15. Here, support 13 supports a tape roll 17 having a first length of tape 19 immediately leaving the roll 17, and a second length of tape 21 emerging from under an auxiliary guide roller 23.

A roll 25 on support 15 may support a supply of label borders, tags, or other tape. Typically roll 25 may not have an adhesive surface, and thus may separate from the roll 25 effortlessly and noiselessly. The material leaving roll 25 has its associated auxiliary guide rollers 27 and 29. In a typical application, the material on the roll 25 may be over laminated with the tape from roll 17.

The tape length of material 19 between the guide roller 23 and its point of separation with the roll 17 has tensile forces applied in order to cause the separation of tape material 19 from the roll 17. The tensile forces cause the length of material 19 to be stressed similar to a drum or speaker. Disturbances created at the separation line where the length of material 19 leaves the roll 17 are magnified and audibly transmitted by the length of material 19.

Where the machine utilizing the tape from roll 17 includes a high speed process, the noise is increased both in frequency and amplitude. The noise arises from the deviations from un-evenness of separation of the tape material 19's separation from the roll 17. This unevenness need not be a grossly jumping action, but such can result where the harmonics of the setup in FIG. 1 encourage it.

Figure 2:
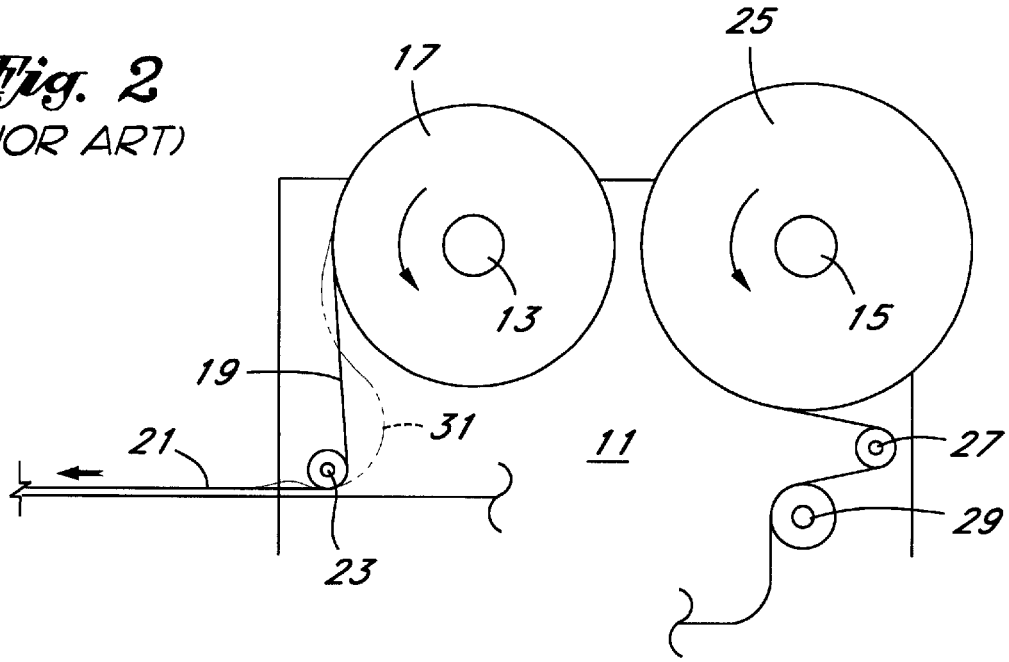
Fig. 2 (PRIOR ART)
FIG. 2 is a schematic plan view of the system of FIG. 1 which illustrates in phantom how the tape can deviate from a constant removal path.

Referring to FIG. 2, the extent to which the unevenness can grow is shown by the phantom line 31. Phantom line 31 illustrates the momentary looseness which the material 19 can achieve in a relatively larger "jump." Multiples of uneven jumps can occur of varying frequency and in random order of occurrence. The entire range of noise can emanate from a roll 17, with slight changes in character as the roll proceeds from a large full roll 17 to a smaller, almost empty roll 17.

Figure 3:
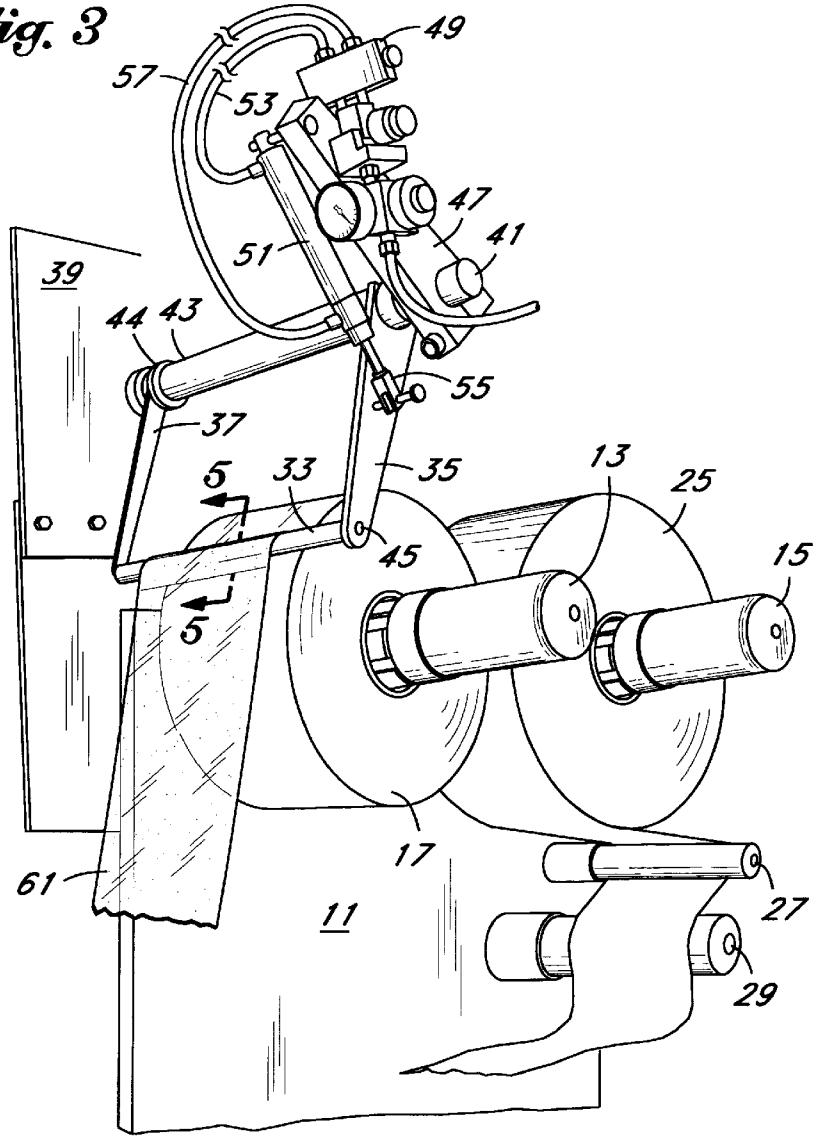
FIG. 3 is a first embodiment of the invention and illustrating a pneumatically powered pivotally mounted separation roller.

Referring to FIG. 3, a pneumatic (or hydraulic) version of the present invention includes many of the same structural elements as were shown in FIGS. 1 and 2, including the supports 13 and 15, rolls 17 and 25, and auxiliary guide rollers 27 and 29.

In the configuration shown for the support 13 and roller 17, the guide roller 23 is omitted and is not needed. Note that there is no first length of tape 19 immediately leaving the roll 17. The tape leaving the roll 17 is tightly urged around a separation roller 33.

The separation roller 33 is freely rotatable and rotatably supported by a pair of pivot arms including an outer pivot arm 35 an inner pivot arm 37. A length of plate 39 has been added to structurally depend from the support 11, or other stable structure. Plate 39 rigidly and non-rotatably supports an internal member 41, the end of which is visible in FIG. 3.

The pivot arms 35 and 37 are preferably supported by a cylindrical sleeve 43 which is adapted to mechanically freely pivot about the internal member 41. The pivot arms 35 and 37 are well attached to the cylindrical sleeve 43, and may include round, land-like reinforcements 44 to further support the pivot arms 35 and 37.

Note the geometry of FIG. 3. The inside pivot arm 37 is made purposely thinner in order to accommodate a brake which is not seen in FIG. 3 and which lies between the roll 17 and the typical support 11. The problem cannot be solved by simply moving the separation roller 33 out, since this action would cause the separation roller 33 to not completely cover the width of the roll 17, and would perhaps cause the pivot arm 37 to drag on the roll 17.

In general, the use of a thinner pivot arm 37 can cause structural weakening, but the use of the reinforcement 44 which is connected directly to the cylindrical sleeve 43 gives adequate structural strength. Viewed another way, the support to the pivot arms 35 and 37 must be such that the pivot arms 35 and 37 are not rotationally displaced with respect to each other due to counter forces from the separation roller 33.

In the present configuration, the pivot arms 35 and 37 gain support from a rigid attachment to the cylindrical sleeve 43, reinforcement 44, as well as by a core rod 45 about which the separation roller 33 is rotatably attached.

Internal member 41 rigidly supports an anchor arm 47. The anchor arm 47 is rigidly fixed and does not rotate. Anchor arm 47 provides an extended length support from which the pivot arms 35 and 37 will anchor their urging support. Anchor arm 47 supports pneumatic valving controls 49 which control a double acting cylinder 51. A first line 53 can be pressurizably activated to cause a cylinder rod 55 to extend from the cylinder 51. A second line 57 can be pressurizably activated to cause the cylinder rod 55 to retract within the cylinder 51.

The end of the cylinder rod 55 is attached to the pivot arm 35. In this configuration, the double acting cylinder 51 can supply the engagement force necessary to urge the separation roller 33 to apply pressure against and rotate with the rotation of the roll 25. The use of the double acting cylinder 51 enables a user to easily cause the separation roller 33 to be urged away from and out of contact with the remnants of a roll 17. In this manner, the operator will not need to physically swing the separation roller out of the way to change to another roll 17.

A length of tape material 61 extends downwardly and away from the separation roller 33. In the system shown in FIG. 3, the force necessary to remove the tape material 61 from the roll 17 can be accomplished by tension on the length of tape material 61. The separation roller 33 acts to dampen any tendency of the roll 17 to jump or to otherwise not maintain a steady release.

More importantly, the separation roller 33 freely rotates about the core rod 45, and the resistance to removal of the tape material 61 from the roll 17 is not increased. Increased resistance does not occur despite the fact that the pivot arms 35 and 37 place significant force on the separation roller 33 and against the tape roll 17. By bringing pressure between the separation roller 33 and tape roll 17, the separation region or line between the tape being wrapped back around the separation roller 33 and the surface of the roll 17 from which it was just removed is significantly stabilized.

The effect on the noise generated is dramatic. As pressure is brought to a significantly compressive level, the tapered space between the tape roll 17 surface, and the tape covered surface of the separation roller 33 comes to control and stabilize the line of separation. The separation roller 33 also eliminates any free, sound propagating tensile length of tape material 19 immediately adjacent the separation region, as was shown in FIGS. 1 and 2. The line of separation moves in direct relation to the turning of the separation roller 33, and allows no room for jumps.

Note that the tape loops up, around the separation roller 33 and downwardly. A full 180° direction of the path of travel is not necessary, but desirable. The tape will preferably cover 180° or more of the compression roller 33, but lesser degrees of angular coverage may work well provided the tension of the compression roller 33 against the tape roll 17 is not lessened or fluctuating under the influence of the tension applied to the length of tape material 61. The use of the 180° or more of the compression will lessen the force to be applied to the anchor arms 37 and 35 to keep the compression roller 33 against the roll 17.

For example, where 45° of the compression roller 33 is covered, the tension on the length of tape material 61 produces a force directly opposed to the force applied to the tape roll 17 by the compression roller 33. In this instance, the force of the compression roller 33 should significantly exceed any counter tension forces from the length of tape material 61 as it is pulled to cause tape to be removed from the tape roll 17. Of course, where the length of tape material 61 covers about 180° of the compression roller 33, the tensile forces placed on the tape material 61 to initiate and maintain removal of tape from the tape roll 17 are normal to the forces applied to the compression roller. By achieving about 180° of coverage, variations in the pull on the tape roll 17 will not be translated into a pulling away of the compression roller 33 with respect to the tape roll.

Enough tension should also be present on length of tape material 61 to keep the length of tape material conformed to the shape of the separation roller 33. Where the separation roller 33 can be urged fully against the roll 17, there will be sufficient force to fully define and control the separation line between the tape roll 17 and each portion of tape removed from the roll. In this case, adequate silenced operation will occur.

Figure 4:
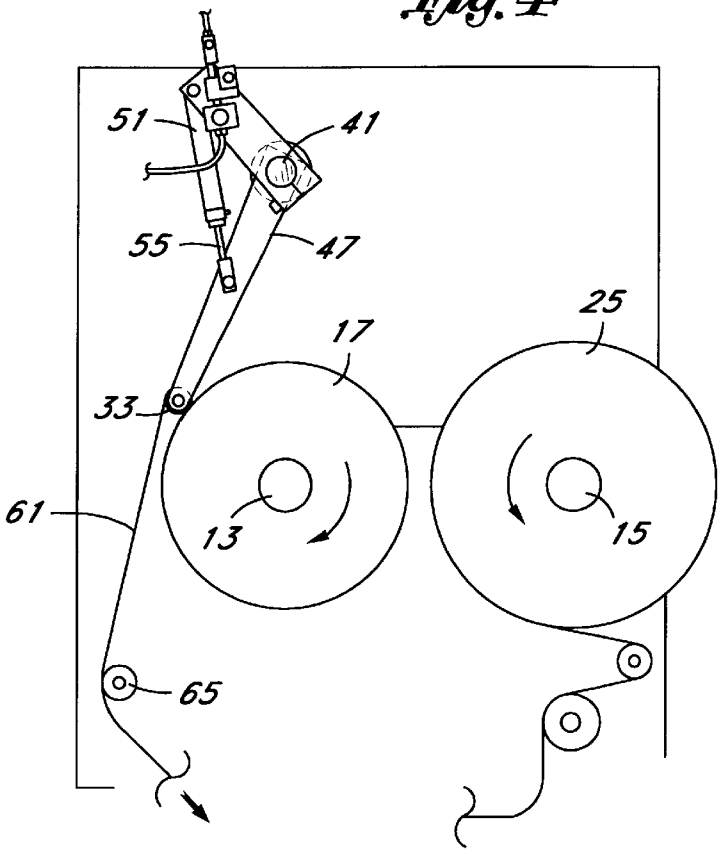
FIG. 4 is a schematic plan view of the system of FIG. 3 which illustrates the tape path interaction with the separation roller.

Referring to FIG. 4, a plan view of the device of FIG. 3 is best seen. Here, an auxiliary roller 65 is shown re-directing the path of flow of the length of tape material 61. Auxiliary roller 65 is not necessary, but merely shown for the possibility of its use. The size of the separation roller 33 is not critical to the operation of the invention. The important factor is to insure that the tape from the roll 17 surrounds the separation roller sufficiently to control the separation of the tape material from the roll 17.

Figure 5:
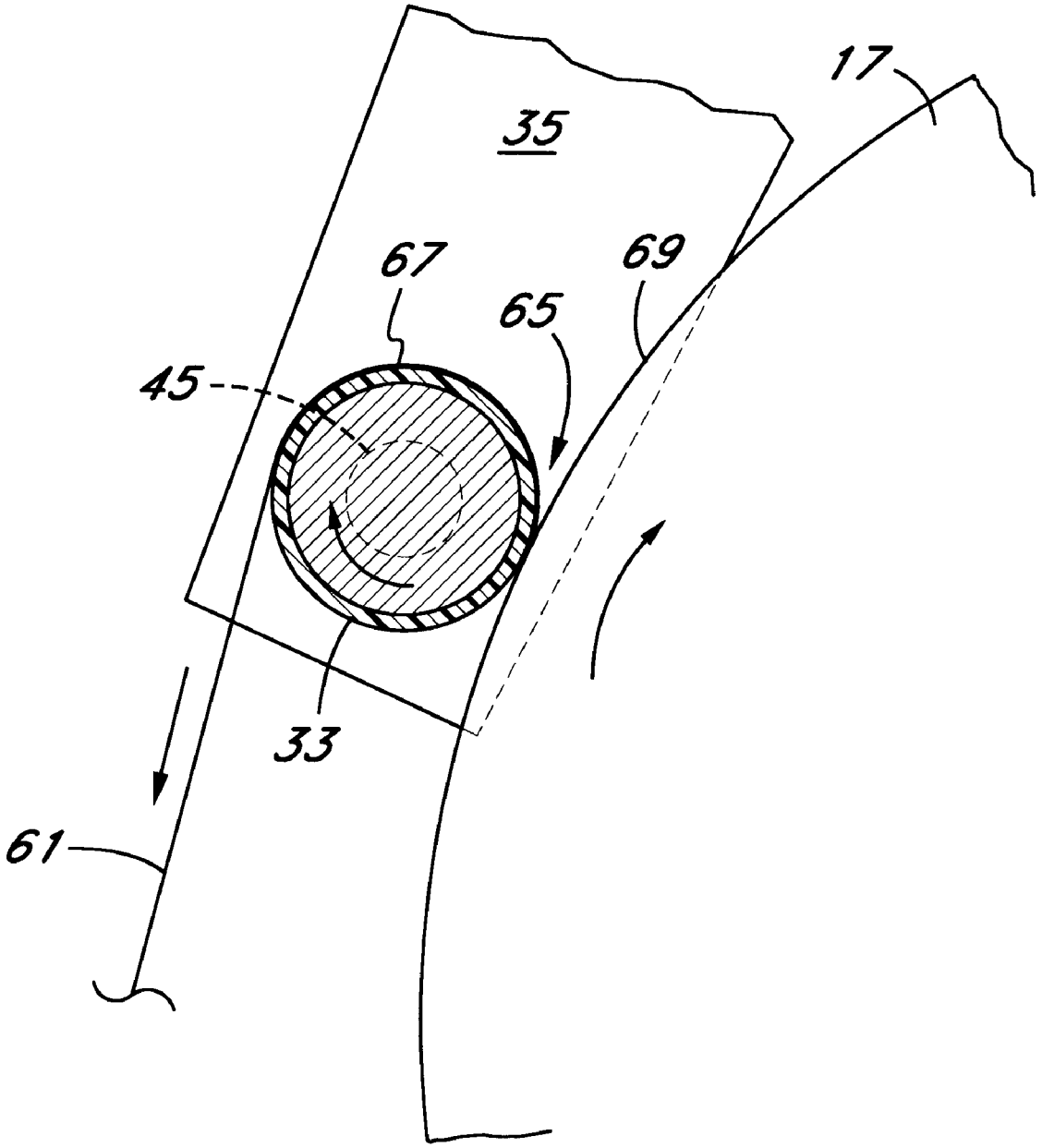
FIG. 5 is a sectional closeup view of the separation roller shown in FIGS. 3 and 4, and an expanded view of the separation interface between the separation roller and the tape roll.

Referring to FIG. 5, a closeup view of the end of the line of separation, seen as a point of separation, is illustrated. Tape from the roll 17 is separated at the apex 65 of a junction formed by a length of tape material 67 which is against the separation roller 33, and an area of tape material 69 from which the length of tape material 67 has just separated. By controlling the pressure of the separation roller 33 against the tape roll 17, the taper 65 can be stabilized and controlled between the separation roller 33 and the roll 17. In this fashion, the apex 65 remains in one position and does not jump about. Further, there is no length of tape material 19 to amplify any sounds occurring at the apex 65.

Figure 6:
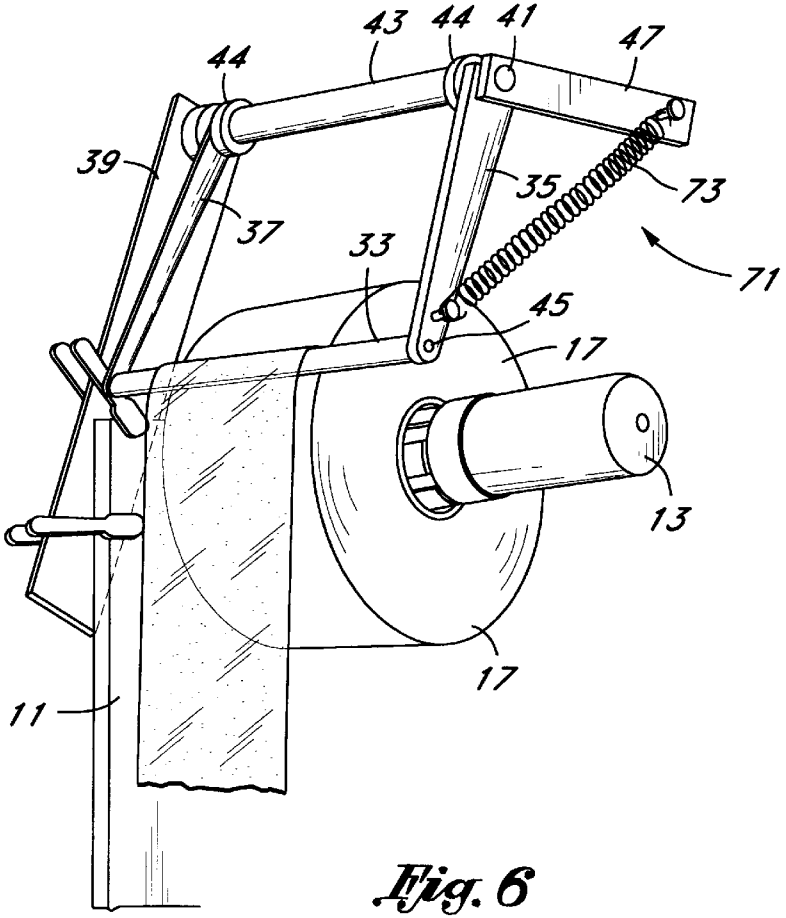
FIG. 6 is a perspective view of a second embodiment of the tape silencing invention where the separation roller is urged against the supply roll by a cantilever mounted spring.

Referring to FIG. 6, a simplified version of the invention is shown as a second embodiment. A spring biased tape silencing device 71 is illustrated in an environment identical to that shown in FIG. 3, but with the roll 25 and its associated components eliminated. In this instance, the force which urges separation roller 33 against roll 17 is provided by a spring 73. Anchor arm 47 is now extended upwardly and to the right, to provide a dual position to be achieved by the separation roller 33.

Figure 7:
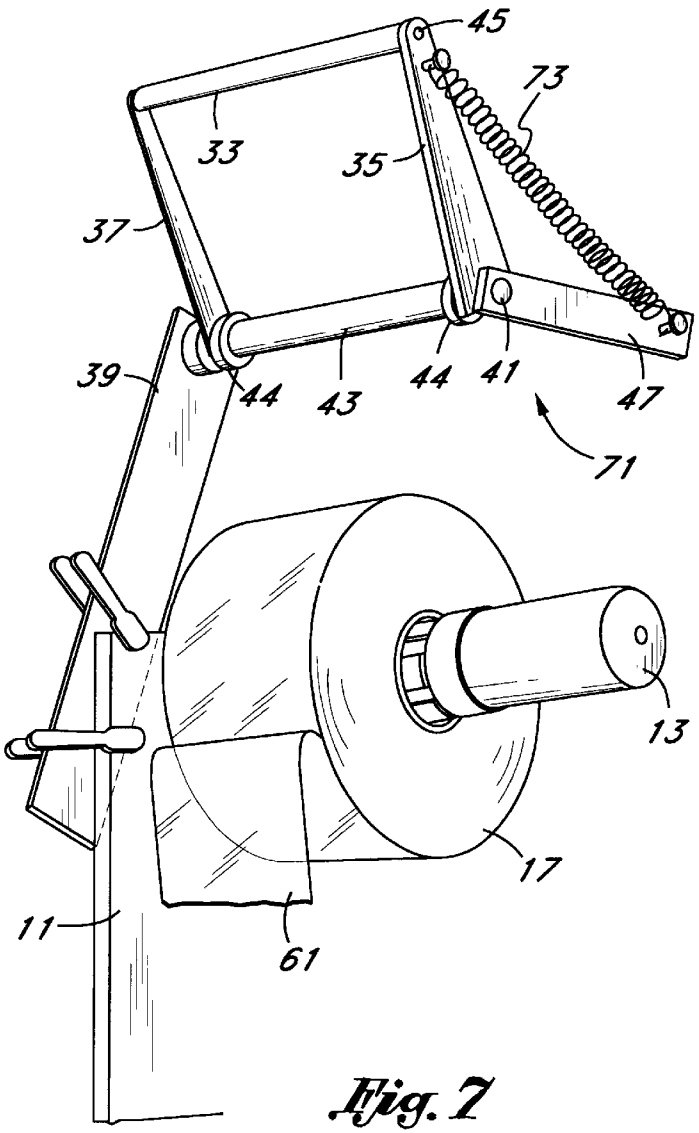
FIG. 7 is a perspective view of the embodiment shown in FIG. 6 and in a position where the separation roller is urged into a second position away from the supply roll axle to facilitate the changing of the supply roll.

The position of anchor arm 47 is angled so that the pivot arms 35 and 37 which engage the compression roller 33 will be urged into one of two stable positions. In the first position, as is shown in FIG. 6, the pivot arm 35 is spring urged in the direction of the roll 17. Referring to FIG. 7, pivot arm 35 and the compression roller 33 have been raised upwardly and out of the way to a second position where the spring 73 now acts to keep the compression roller 33 removed from contact with the roll 17. Since the spring 73 provides the force which urges the compression roller 33 against the roll 17, the force applied will be in proportion to both the size of the roll and the angle the pivot arm 35 makes with respect to the anchor arm 47. Therefore a spring 73 having adequate force characteristics should be selected to give good urging contact of the compression roller 73 against the roll 17 throughout the range of diameters which roll 17 will assume during tape removal.

Figure 8:
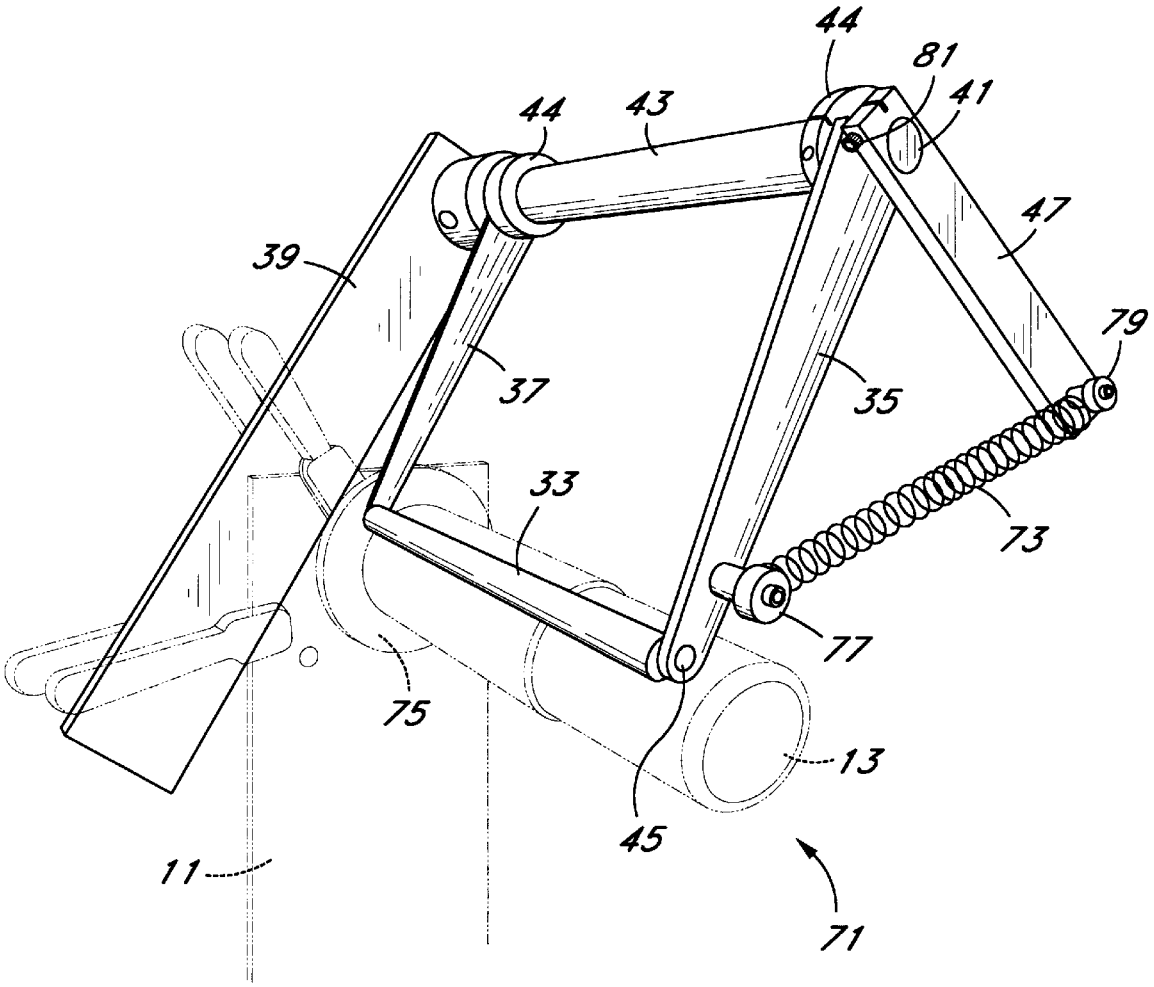
FIG. 8 is an enlarged perspective view which illustrates further details of the embodiments of FIGS. 6 & 7.

Referring to FIG. 8, an enlarged perspective view as was shown in FIGS. 6 and 7 is shown, but without the presence of the roll 25. Shown is a brake 75 which occupies some space between the typical support 11 and the roll 17 when roll 17 is mounted to the support 13. Note that the inner pivot arm 37 lies outside of the brake and that the roll 17, when mounted on the support 13 may closely approach the brake 75 with only enough space between the brake 75 and the roll 17 to accommodate the relatively thin pivot arm 37.

The spring 73 is mounted near a first teflon or expanded plastic fitting 77 located on the pivot arm 35. This facilitates manual disengagement of the separation roller 33 by swinging the pivot arm 35 clockwise to cause the cylindrical sleeve to also pivot around the internal member 41. A second plastic fitting 79 is located on the anchor arm 47 to facilitate any adjusting displacement of the anchor arm 47. Both the plastic fittings 77 and 79 may be threadably inserted into the outer pivot arm 35 and the anchor arm 47. As can be seen, a set screw 81 can be used to lock the anchor arm 47 in place with respect to the end of the internal member 41. This enables some adjustment as may be needed for smaller or larger rolls, or for disassembly. Once the anchor arm 47 is removed, the other portions of the spring biased tape silencing device 71 may also be removed.

While the present invention has been described in terms of a silencing device and process for use during removal of tape from a roll, one skilled in the art will realize that the structure and techniques of the present invention can be applied to many appliances. The present invention may be applied in any situation where a separation is to occur as noiselessly as possible.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A tape silencing device comprising:

a compression roller freely rotatable about a first axis; and a first pivot arm and a second pivot arm spaced apart and extending parallel to said first pivot arm, each said pivot arm having a first end rotatably supporting said compression roller, said first and second pivot arms pivotally mounted to pivot said compression roller into contact with a tape roll and away from contact with a tape roll, said first and second pivot arms each having a second end;

a hollow cylindrical sleeve having a first end connected to said second end of said first pivot arm and a second end connected to said second end of said second pivot arm;

a supported rotationally fixed internal member having a first end for rigid rotationally fixed attachment and a second end, and which supports said cylindrical sleeve between said first and second ends of said rotationally fixed internal member, and within said hollow cylindrical sleeve, and about which said cylindrical sleeve pivots;

a fixed support rigidly attached to and extending away from said second end of said supported internal member;

a force device connected between said fixed support and one of said first and said second pivot arms for urging said one of said first and said second pivot arms and said compression roller against a tape roll rotatable about a second axis, said compression roller enabled to guide tape from said tape roll around said compression roller; said force device able to control and maintain a controlled taper between tape on said tape roll and said tape guided around said compression roller.

2. The tape silencing device as recited in claim 1 wherein said force device is fluid powered.

3. The tape silencing device as recited in claim 1 wherein said force device is a spring.

4. The tape silencing device as recited in claim 3 wherein said fixed support extends away from said supported internal member at a right angle from said supported internal member in a first direction, and wherein said first and second pivot arms are pivotable through an arc crossing a second direction opposite said first direction and said compression roller is oriented such that when said first and second pivot arms are moved to one side of said second direction the compression roller is urged toward contact with said tape roll, and when moved to the other side of said second direction, the compression roller is urged by said spring away from contact with said tape roll.

5. The tape silencing device of claim 1 wherein said first pivot arm is thinner than said second pivot arm.

6. The tape silencing device of claim 1 wherein said force device is a cylinder actuator including a cylinder having a first end attached to said fixed support and a second end, said cylinder supporting a cylinder rod extending from the second end of said cylinder and connected to at least one of said first and said second pivot arms.

7. The tape silencing device of claim 6 wherein said cylinder actuator is a double acting actuator for urging said compression roller against a tape roll and for urging said compression roller away from said tape roll.

8. The tape silencing device as recited in claim 7 and further comprising a control, in fluid communication with said cylinder actuator to control the force applied to said compression roller.

9. The tape silencing device as recited in claim 1 and further comprising:

a tape roll axle having said second axis;

a tape roll rotatable on said axis and having a length of material extending around said compression roller and away from said compression roller.

10. The tape silencing device as recited in claim 9 wherein said length of material extending around said compression roller covers 180° of the compression roller.

11. The tape silencing device as recited in claim 1 and further comprising a plate, attached to said first end of said supported internal member to facilitate the quick and adjustable attachment of said tape silencing device to another structure.

12. A process of silencing noise from a tape roll during removal of tape from the roll comprising the steps of:

supporting a rotationally fixed internal member from a fixed support, said rotationally fixed internal member having a first end for rigid rotationally fixed attachment to said fixed support and a second end for supporting a cylindrical sleeve between said first and said second ends of said rotationally fixed internal member and said internal member being positioned within said hollow cylindrical sleeve;

supporting a pair of pivot arms having first ends and second ends, said first ends attached to said sleeve, said sleeve pivotally supported from said internal member;

pressing a freely rotatable compression roller supported by said second ends of said pivot arms against a tape roll by applying force between said second end of said internal member and one of said pair of pivot arms;

causing a length of tape to extend beyond a point of compression of said tape roll, around said compression roller and away from said compression roller; and applying tension forces to said length of tape to initiate and continue the removal of tape from said tape roll, assisted by use of a force device which applies said force and which is connected between said second end of said internal member and one of said first and said second pivot arms and said compression roller against said tape roll rotatable about a second axis, said compression roller enabled to guide said tape from said tape roll around said compression roller;, said force device to control and maintain a controlled taper between said tape on said tape roll and said tape guided around said compression roller, to initiate and continue the removal of tape from said tape roll.

13. The process of silencing noise from a tape roll during removal of tape from the roll as recited in claim 12 where said length of tape extends around said compression roller and covers about 180° of the compression roller during said removal of tape from said tape roll.

* * * * *